US007932891B2

(12) United States Patent
Huang et al.

(10) Patent No.: US 7,932,891 B2
(45) Date of Patent: Apr. 26, 2011

(54) DRIVING METHOD AND SYSTEM THEREOF FOR LCD MULTIPLE SCAN

(75) Inventors: Ming-Wei Huang, Taoyuan County (TW); Wen-Tse Tseng, Taoyuan County (TW); Mu-Shan Liao, Changhua County (TW); Juin-Ying Huang, Taoyuan County (TW)

(73) Assignee: Chunghwa Picture Tubes, Ltd., Taoyuan (TW)

( * ) Notice: Subject to any disclaimer, the term of this patent is extended or adjusted under 35 U.S.C. 154(b) by 1129 days.

(21) Appl. No.: 11/162,496

(22) Filed: Sep. 13, 2005

(65) Prior Publication Data

US 2007/0057904 A1 Mar. 15, 2007

(51) Int. Cl.
*G09G 3/36* (2006.01)

(52) U.S. Cl. ..... 345/103

(58) Field of Classification Search ..... 345/33, 345/55, 63, 77, 89, 690, 694, 695, 696, 698
See application file for complete search history.

(56) References Cited

U.S. PATENT DOCUMENTS

| | | | | |
|---|---|---|---|---|
| 5,182,664 | A | 1/1993 | Clerc | 349/33 |
| 5,619,224 | A | 4/1997 | Hoshino et al. | 345/98 |
| 7,277,092 | B2 * | 10/2007 | Shen et al. | 345/204 |
| 2001/0040546 | A1 | 11/2001 | Ohmuro et al. | 345/87 |
| 2002/0171640 | A1 | 11/2002 | Bu et al. | 345/208 |
| 2003/0043103 | A1 * | 3/2003 | Yoshihara et al. | 345/87 |
| 2003/0048247 | A1 | 3/2003 | Ham | |
| 2004/0196254 | A1 | 10/2004 | Mizumaki | |
| 2005/0057481 | A1 * | 3/2005 | Chung | 345/100 |

OTHER PUBLICATIONS

"1st Office Action of German counterpart application", issued on Feb. 22, 2010, p. 1-p. 4.

* cited by examiner

*Primary Examiner* — Sumati Lefkowitz
*Assistant Examiner* — Tammy Pham
(74) *Attorney, Agent, or Firm* — Jianq Chyun IP Office

(57) ABSTRACT

A multiple scan method for driving a display and a display therewith is provided. The multiple scan method is achieved by alternately driving the active pixels in the display twice or more times for expediting response time of these active pixels to reach the target luminance in the display. The pixels in the display are charged or discharged twice or more times within one frame period. By such design, the response time is shortened and quality for showing motion pictures is significantly improved.

18 Claims, 3 Drawing Sheets

DRIVING METHOD AND SYSTEM THEREOF FOR LCD MULTIPLE SCAN

BACKGROUND OF THE INVENTION

1. Field of the Invention

The present invention relates to a scan method for driving a display and a display therewith, and more particularly, to a multiple scan method for driving a display and a display therewith, by dividing active pixel area and alternately driving these divided active pixel area for expediting response time of these active pixels in the display.

2. Description of Related Art

As computer technology advances and as Internet and multimedia are highly being developed, current information is transmitted in digital form instead of analog form, and novel display apparatuses are being invented. A conventional CRT, structured with an inner electronic cavity structure occupying substantial space, and radiation harmful to human eyes, is gradually being eliminated from the display market. Therefore, a flat panel display fabricated with optoelectronic technology and semiconductor process, such as a liquid crystal display (LCD), an organic light emitting display (OLED), or a plasma display panel (PDP) display, is becoming main trend of research and development.

A plurality of pixels arranged in an array constitutes a frame in a display. The pixel is a basic unit for displaying in the display. In a flat panel display, for example, a driving potential is generated according to a pixel data to charge the pixel for showing luminance accordingly. A display is generally driven by a horizontal sync signal and a vertical sync signal, which is applied to a gate driving unit and a source driving unit respectively. The horizontal sync signal determines a number of rows to display in a specific time period, and the vertical sync signal determines a display time length of each frame. A time interval taken between every two adjacent vertical sync signals is a frame period. The vertical sync signal can as well be characterized with a reciprocal of the frame period, i.e. a frame rate. In general, a frame rate of a computer monitor is not less than 60 Hz, i.e., a display device is able to show more than 60 frame data in a second, where each frame period is no longer than 16.7 ms.

According to the flat panel display technology, an ordinary vertical scanning frequency is 60 Hz. A conventional scanning method is implemented by a source driving unit and a gate driving unit which are operated once of each in a frame period, which is shown in FIG. 1. A display 100 includes a display panel 110, a source driving device 120 and a gate driving device 130. The source driving device 120 includes a plurality of source drivers 121 and the gate driving device 330 includes three gate drivers 102, 104 and 106. Each pixel of the panel in the display is changed one time during the frame period. A charging curve is depicted as an original temporal response curve 410 shown in FIG. 4. The response time of the pixels corresponding to the pixel data is an important issue for improving the display quality for the flat panel display, especially for displaying objects in motion. It is not considered and also difficult in the conventional architecture for improving the response time of the pixels.

Architecture for speeding up the response time of the pixels is proposed in the US Patent Application Publication No. US2002/017640, titled "Method of Display by Sub-Frame Driving", pub. Date on Nov. 21, 2002. In the architecture, under the same vertical display condition, e.g. a 60 Hz frame rate is provided, that is, a frame lasts for about 16.7 ms. A frame period, where a picture having m×n pixels thereof, is divided into k sub frame periods. A driving potential is applied to the pixels, such that the liquid crystal response time is expedited. The driving potential is a target potential plus a driving offset for respective sub frame period. Referring to FIG. 2, a driving potential waveform diagram of a frame is illustrated, where the frame includes m×n pixels divided into sub-frame-periods of k=2, for example.

In FIG. 2, a first sub frame is displayed between time point $t_{s0}$ and time point $t_{s1}$ and a second sub frame is displayed between time point $t_{s1}$ and time point $t_{sf}$. A driving potential $V_O$ corresponding to the first sub frame is the original target driving potential $V_D$ plus a driving offset potential $\Delta V_1$. Whereas a driving potential corresponding to the second sub frame is the original target driving potential $V_D$ plus a driving offset potential $\Delta V_2$, e.g. $\Delta V_2=0$. By such driving design, therefore, a response time of a liquid crystal of the LCD is shortened.

According to the conventional art described above, however, the driving offset potential provided is not precise as desired, the driving potential for each sub frame cannot be expected, which results in unstable picture quality in a LCD. Furthermore, the driving offset amount generated according to conventional art is based on an over-driving technique. Therefore, a frame buffer, e.g. an SDRAM in general, for storing pixel data, and a memory, e.g. an electrically erasable programmable read-only memory (EEPROM) in general, for storing a look up table are additionally disposed, for calculating driving offset potential correspondingly.

According to the above descriptions, hardware such as a frame buffer and a memory for storing a look up table are additionally disposed for obtaining driving offset potentials, where a precise driving offset potential is hardly achieved by over-driving technique without complicated calculation mechanism. Therefore, a novel multiple driving method for a LCD is desired, where additional hardware is not needed, and driving potential can be easily and precisely generated.

SUMMARY OF THE INVENTION

Accordingly, the present invention is directed to a multiple scan method for driving a display and a display therewith. The multiple scan method is achieved by alternately driving the active pixels in the display for expediting response time of these active pixels to reach the target luminance in the display. The pixels in the display are charged or discharged twice or more times within one frame period.

In one embodiment of the proposed multiple scan method for driving a display, the pixels arranged as a matrix constituted with a plurality of rows and columns are divided into a plurality of pixel blocks, which are driven by a gate driving device including a plurality of gate drivers. The pixels within each of the pixel blocks are charged or discharged twice or more times with a target voltage within one frame period in order to speed up the response time of the pixels to reach a target luminance. The times for the pixels within each of the pixel blocks being charged or discharged and the time intervals for the driving are determined according to the design.

According to an embodiment of the present invention, a multiple scanning method for driving a display is provided. The display comprises a display panel, a source driving device and a gate driving device, where the gate driving device comprises a plurality of gate drivers. The method comprising dividing display panel into a plurality of pixel blocks for driving, each of the pixel blocks comprising a plurality of pixels and is driven by one of the gate drivers and alternately scanning the pixel blocks to selectively charge the pixels in the pixel blocks with a target voltage twice or more times within a frame period, thereby to speed up the response time of the pixels to reach a target luminance.

In the multiple scanning method for driving a display as above, if the gate driving device has X gate drivers and each of the gate drivers has N output channels, a scan cycle coefficient M is defined as every M scan lines, the gate driver scan the M scan lines again, a time to charge the pixels for the second time is $(M\times T)/(2\times N\times X)$, where T is the frame period.

In the multiple scanning method for driving a display as above, if the gate driving device has X gate drivers and each of the gate drivers has N output channels, a scan cycle coefficient M is defined as every M scan lines, the gate driver scan the M scan lines again, a sequence number S is defined as N/M, a second time point to charge the pixels for the second time is $(2-1)\times(M\times T)/(R\times N\times X)$, and a third time point for driving the pixel is $(3-1)\times(M\times T)/(R\times N\times X)$, wherein S, N, X, M and R are integers.

DESCRIPTION OF THE EMBODIMENTS

The invention proposes a multiple scan method for driving a display by alternately driving the active pixels in the display for expediting response time of these active pixels to reach the target luminance in the display. The pixels in the display are charged or discharged twice or more times within one frame period.

In one embodiment of the proposed multiple scan method for driving a display, the pixels arranged as a matrix constituted with a plurality of rows and columns are divided into a plurality of pixel blocks, which are driven by a gate driving device including a plurality of gate drivers. The pixels within each of the pixel blocks are charged or discharged twice or more times with a target voltage within one frame period in order to speed up the response time of the pixels to reach a target luminance. The times for the pixels within each of the pixel blocks being charged or discharged and the time intervals for the driving are determined according to the design. In the invention, the target voltage is used twice or more times to charge the pixels to speed up the response time of the pixels to reach a target luminance.

A multiple scan method for driving a display by dividing active pixels into a plurality of blocks and alternately driving these divided pixel blocks for expediting response time of these active pixels in the display. In one embodiment of the invention, the pixels in the display are charged or discharged twice or more times with a target voltage within one frame period in order to speed up the response time of the pixels to reach a target luminance. By such design, the response time is shortened and quality for showing motion pictures is significantly improved. The scan method for driving is applicable to any type of displays, including a liquid crystal display (LCD), organic light emitter diode display (OLED), plasma display panel (PDP), etc.

In one embodiment of a multiple scan method for driving a display of the present invention, the pixels arranged as a matrix constituted with a plurality of rows and columns are divided into a plurality of pixel blocks, which are driven by a gate driving device including a plurality of gate drivers. The pixels within each of the pixel blocks are charged or discharged twice or more times with a target voltage within one frame period in order to speed up the response time of the pixels to reach a target luminance. The times for the pixels within each of the pixel blocks being charged or discharged and the time intervals for the driving are determined according to the design.

Figure 1:
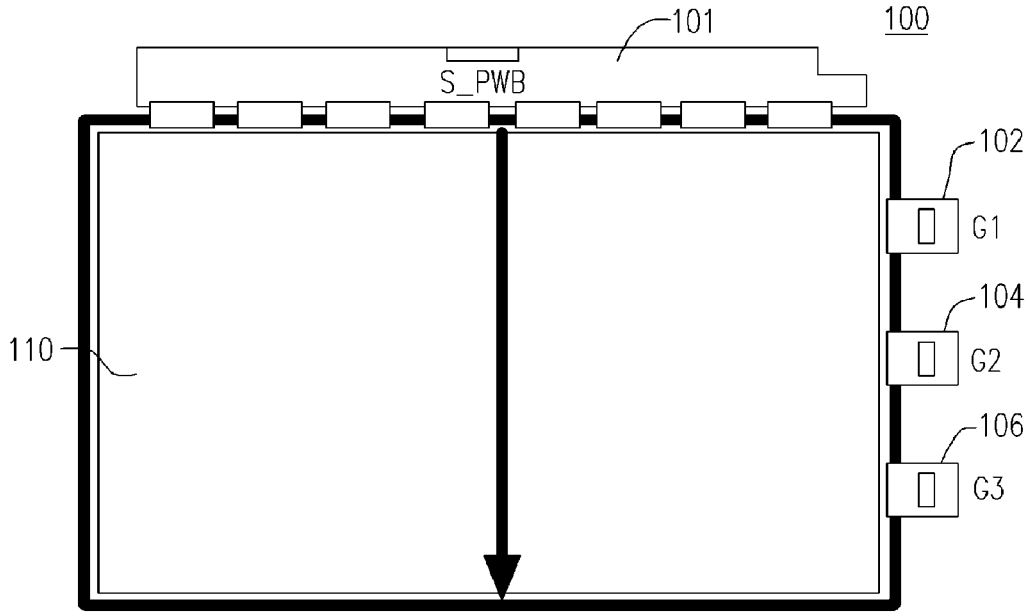
FIG. 1 (PRIOR ART)
FIG. 1 is a schematic block diagram illustrating of a conventional LCD.
Figure 2:
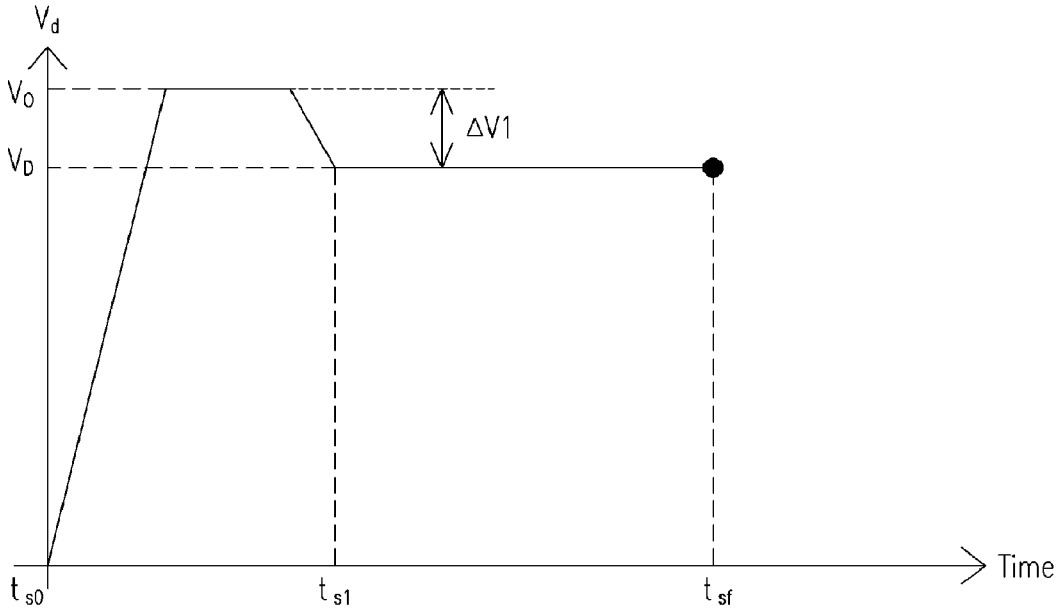
FIG. 2 (PRIOR ART)
FIG. 2 is a schematic diagram illustrating potential driving waveform of a conventional LCD.
Figure 3:
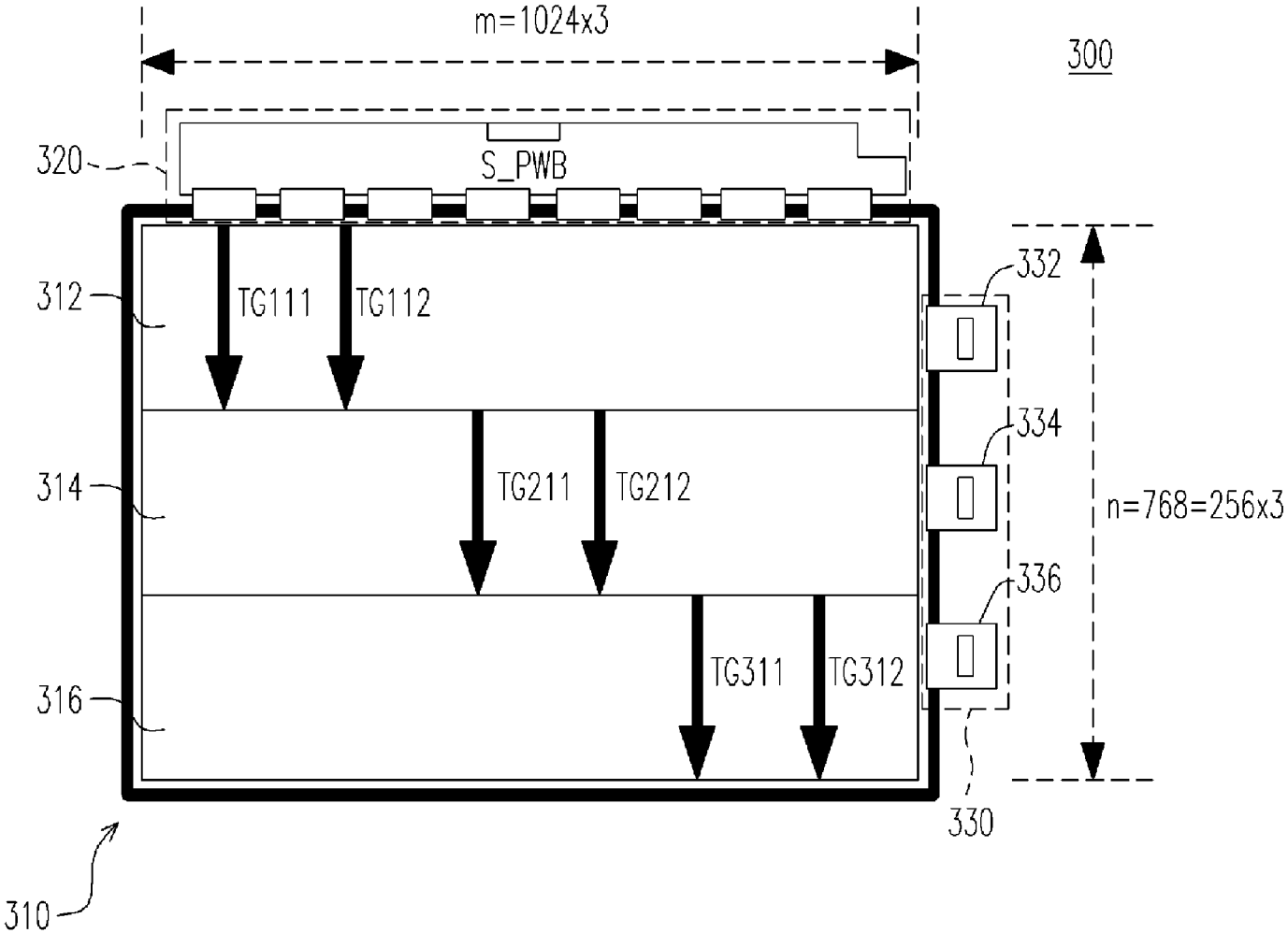
FIG. 3 is a schematic diagram illustrating a multiple scanning method of a LCD according to one embodiment of the present invention.
Figure 4:
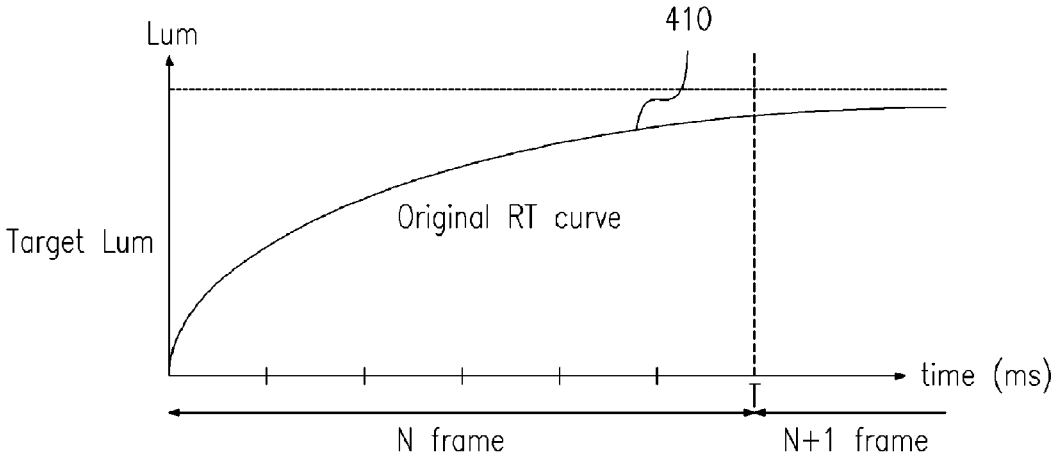
FIG. 4 is a schematic waveform diagram illustrating temporal response of a liquid crystal of a LCD according to conventional art.

Referring to FIG. 3, a schematic diagram of a multiple scanning method for driving a display 300 according to one embodiment of the present invention is illustrated. In the present embodiment of the present invention, the display 300 includes a display panel 310, a source driving device 320 and a gate driving device 330. The source driving device 320 includes a plurality of source drivers and the gate driving device 330 includes a plurality of gate drivers. In the embodiment, for explanation, the gate driving device 330 includes three gate drivers 332, 334 and 336 as example but not limited to. The number of the gate drivers in the gate driving device 330 depends on the design of the driving architecture of the display 300.

To illustrate the embodiment of the present invention, a frame having m×n pixel data is taken as an example, where m=1024×3, n=768. As shown in FIG. 3, a frame is divided into X pixel blocks for driving within a frame period. For explanation, the frame is divided into three pixel blocks 312, 314 and 316, where each of the blocks has 1024×3×256 pixels for displaying corresponding pixel data.

In the embodiment, each of the gate drivers 332, 334 and 336 has 256 output channels. Referring to FIG. 3, when the display 300 begins to display the frames, the gate driver 332 turns on a transistor coupled to a first scan line and the pixel connected to the transistor is selectively charged with a target voltage applied from a data line coupled to the pixel. The pixels in the display are charged with the target voltage to reach a target luminance. The target voltage is determined in according to the target luminance, which depends on the data applied to the display. A transistor coupled to a second scan line is successively turned on by the gate driver 332 and the pixel connected to the transistor is charged or discharged. Until all of transistors coupled to the 256 scan lines driven by the corresponding channels of the gate driver 332 are successively turned on and the pixels connected to the transistors are charged or discharged. A first sub frame including 1024×3×256 pixel data is displayed in the pixel block 312.

Then the gate driver 332 goes back to turn on the transistor coupled to the first scan line, and successively turn on the transistor coupled to the second scan line, and then successively turn on the other transistors coupled to the scan lines corresponding to the other channels of the gate driver 332 until the 256 scan lines are driven again by the gate driver 332. The first sub frame including 1024×3×256 pixel data is displayed again in the pixel block 312. In the embodiment, if the output channels of the gate driver 332 are CH1~CH256, the order for driving the scan lines corresponding to these output channels are CH1, CH2, CH3, . . . , CH255, CH256, CH1, CH2, CH3, . . . , CH255 and CH256. The pixels in the in the pixel block 312 are charged or discharged twice within one frame period in order to speed up the response time of the pixels to reach a target luminance.

After the first sub frame is displayed in the pixel block 312 twice, the gate driver 334 begins to successively turn on the transistors coupled to the scan lines corresponding to the channels of the gate driver 334 until the 256 scan lines are driven by the gate driver 334 and pixels connected to the transistors are successively and selectively charged with a target voltage applied from the data lines coupled to the pixels. A second sub frame including 1024×3×256 pixel data is displayed in the pixel block 314. Then the gate driver 334 goes back again to successively turn on the transistors coupled to the scan lines corresponding to the channels of the gate driver 334 until the 256 scan lines are driven by the gate driver 334. The second sub frame including 1024×3×256 pixel data is displayed again in the pixel block 314. In the embodiment, if the output channels of the gate driver 334 are CH1~CH256, the order for driving the scan lines corresponding to these output channels are CH1, CH2, CH3, . . . , CH255, CH256, CH1, CH2, CH3, . . . , CH255 and CH256.

After the second sub frame is displayed in the pixel block 314 twice, the gate driver 336 begins to successively turn on the transistors coupled to the scan lines corresponding to the channels of the gate driver 336 until the 256 scan lines are driven by the gate driver 336 and pixels connected to the transistors are successively and selectively charged with a target voltage applied from the data lines coupled to the pixels. A third sub frame including 1024×3×256 pixel data is displayed in the pixel block 316 twice, as the similar manner disclosed above.

According to the embodiment of the invention, as shown in FIG. 3, the scanning step of the display 300 follows the order TG111→TG112→TG211→TG212→TG311→TG312. Based on the multiple scanning method proposed in the embodiment, the pixels are charged with a target voltage twice within a frame period T in order to speed up the response time of the pixels to reach a target luminance. Moreover, in the case that the pixels are charged or discharged twice within the frame period T, a cycle time for the gate driver to successively turn on the transistors coupled to the scan lines corresponding to all of the channels of the gate driver, e.g. from channel CH1 to channel CH256, is substantially about T/6 (based on dividing the frame into three pixel blocks). That is, the pixels charged with the original driving voltage will be charged again after substantially about T/6 from the time of the beginning.

Figure 5:
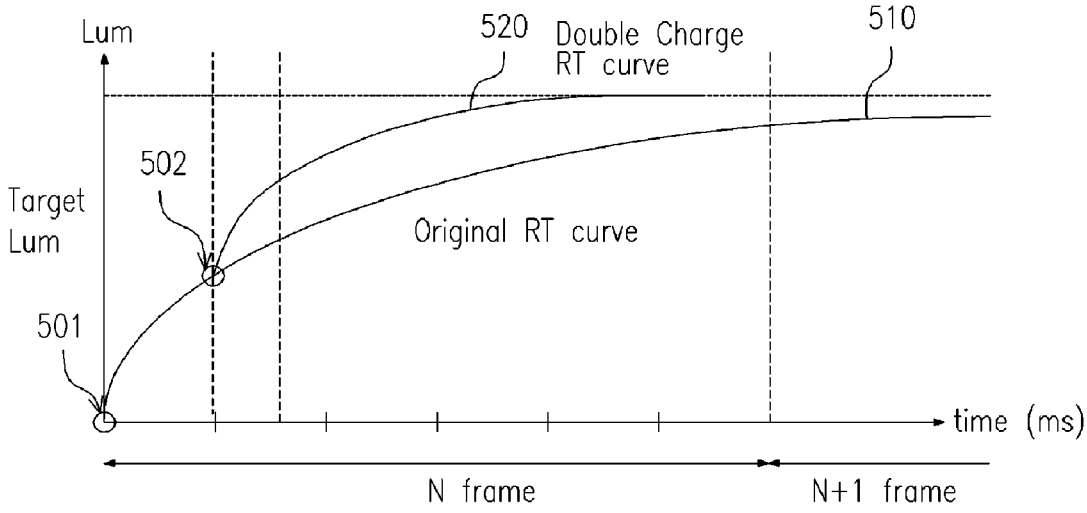
FIG. 5 is a schematic waveform diagram illustrating temporal response of a liquid crystal of a LCD according to one embodiment of the present invention.

Referring to FIG. 5, a schematic waveform diagram showing the relationship between time and luminance of the pixels in the display applied with a conventional scanning method and the multiple scanning method proposed in the embodiment. As shown, with reference to a Nth frame, according to one embodiment of the present invention, a pixel is charged twice at a first point 501 and a second point 502 within a frame period T, respectively. Regarding the first point 501 at time Ton_1, the pixel is charged with a target voltage in the beginning and, at time Ton_2, substantially after T/6 from the time Ton_1, the pixel is charged again with the target voltage, referring to the second point 502. According to a curve depicted in FIG. 5, when the target voltage is applied to the pixel for the first time, the response time is depicted as a curve 510, similar to that of conventional art. Whereas when the target voltage is applied to the pixel for the second time, the response time is depicted as a curve 520, where the target luminance for the pixel is responded faster than the conventional art and the target luminance is reached more rapidly.

According to one embodiment of the present invention, if the gate driving device has only two gate drivers in a display, a frame can be divided into two pixel blocks for driving within a frame period. The pixel is charged with a target voltage in the beginning and substantially after T/4 from the beginning, the pixel is charged again with the target voltage. That is, a frame is divided into two pixel blocks for scanning purpose, Ton_1 is the time the driving is initiated and Ton_2 becomes T/4. Generally speaking, if the gate driving device has X gate drivers in a display, the time Ton_2 to charge the pixel for the second time can be expressed by equation T/(2×X), where T is the frame period.

Furthermore, according to another embodiment of the present invention, if the gate driving device has X gate drivers and each of the gate drivers has N output channels. A scan cycle coefficient M is defined as every M scan lines, the gate driver will rescan again. In the case that M=256, it means that every 256 scan lines, the gate driver will rescan from the first scan line of all of the scan lines coupled to the gate driver. The time Ton_2 to charge the pixel for the second time can be expressed by equation (M×T)/(2×N×X), where T is the frame period.

As described above, the invention provides a multiple scan method for driving a display by dividing active pixels into a plurality of pixel blocks and alternately driving these divided pixel blocks for expediting response time of these active pixels to reach the target luminance in the display. The pixels in the display are charged or discharged twice or more times within one frame period. It is assumed that a refresh coefficient R is defined as the times the pixels are charged or discharged. In the case that R=2, which is shown in the first embodiment, the pixels in the display are charged or discharged twice within one frame period and the active pixels are divided into three pixel blocks for the driving purpose. The scanning step of the display follows the order TG111→TG112→TG211→TG212→TG311→TG312, as shown in FIG. 3. In the case that R=3, the pixels in the display are charged or discharged three times within one frame period and the active pixels are divided into three pixel blocks for the driving purpose. The scanning step of the display follows the order TG111→TG112→TG113→TG211→TG212→TG213→ TG311→TG312→TG313.

In the multiple scanning method of the invention, a plurality of coefficients can be determined in advance for different designs as desired. It is assumed that the gate driving device has X gate drivers and each of the gate drivers has N output channels. A scan cycle coefficient is defined as M and a refresh coefficient is defined as R, as introduced above. A sequence number S is defined as N/M, which means that in the N channels of each of the gate driver, the gate driver will rescan every M scan lines and S times for performing the M-scan-line scanning operation. A scanning sequence according to the present invention is: TG111→TG112→TG113→TG11R→TG121→TG122→ . . . →TG1SR→TG211→TG212→TG213→TG21R→TG221→TG222→ . . . →TG2SR→ . . . →TGXSR. For example, a first time point Ton_1 for driving the pixel is (1−1)×(M×T)/(R×N×X)=0, a second time point Ton_2 for driving the pixel is (2−1)×(M×T)/(R×N×X), a third time point Ton_3 for driving the pixel is (3−1)×(M×T)/(R×N×X), etc., wherein S, N, X, M and R are integers.

The invention proposes a multiple scan method for driving a display by alternately driving the active pixels in the display for expediting response time of these active pixels to reach the target luminance in the display. The pixels in the display are charged or discharged twice or more times within one frame period.

In one embodiment of the proposed multiple scan method for driving a display, the pixels arranged as a matrix constituted with a plurality of rows and columns are divided into a plurality of pixel blocks, which are driven by a gate driving device including a plurality of gate drivers. The pixels within each of the pixel blocks are charged or discharged twice or more times with a target voltage within one frame period in order to speed up the response time of the pixels to reach a target luminance. The times for the pixels within each of the pixel blocks being charged or discharged and the time intervals for the driving are determined according to the design. In the invention, the target voltage is used twice or more times to charge the pixels and there is no such problem in the conventional art that when the driving offset potential provided is not precise as desired, the driving potential for each sub frame cannot be expected, which results in unstable picture quality in the display. Furthermore, in the invention, it is not required to add the a frame buffer for storing pixel data and a memory for storing a look up table to calculate driving offset potential correspondingly.

Although the invention has been described with reference to a particular embodiment thereof, it will be apparent to those skilled in the art that modifications to the described embodiment may be made without departing from the spirit of the invention. Accordingly, the scope of the invention will be defined by the attached claims and not by the above detailed description.

What is claimed is:

1. A multiple scanning method for driving a display, the display comprising a display panel, a source driving device and a gate driving device, the gate driving device comprising a plurality of gate drivers, the method comprising:

dividing the display panel into a plurality of pixel blocks for driving, each of the pixel blocks comprising a plurality of pixel rows, and each of the plurality of pixel rows comprising a plurality of pixels and being driven by one of the gate drivers; and alternately scanning the pixel blocks to selectively charge the pixels in each of the pixel blocks twice with a same target voltage within an entire frame period, thereby to speed up the response time of the pixels to reach a target luminance, wherein when all of the pixel rows in a prior pixel block are sequentially scanned from the $1^{st}$ pixel row to the last pixel row by a first gate driver of the gate drivers, and each of the pixels of all of the pixel rows in the prior pixel block is coordinately charged with a predetermined target voltage by the source driving device for a first time, and then immediately all of the pixel rows in the prior pixel block are sequentially scanned from the $1^{st}$ pixel row to the last pixel row by the first gate driver again, and each of the pixels of all of the pixel rows in the prior pixel block is coordinately charged with the predetermined target voltage by the source driving device for a second time, and then when each of the pixels of all of the pixel rows in the prior pixel block is charged with the predetermined target voltage twice, all of the pixel rows in a current pixel block are scanned by a second gate driver of the gate drivers and coordinately charged by the source driving device in the same manner as to the prior pixel block.

2. The multiple scanning method for driving a display as claimed in claim 1, wherein if the gate driving device has X gate drivers in the display, a time to charge the pixels for the second time is T/(2×X), where T is the entire frame period.

3. The multiple scanning method for driving a display as claimed in claim 1, wherein if the gate driving device has three gate drivers in the display, a time to charge the pixels for the second time is T/6, where T is the entire frame period.

4. The multiple scanning method for driving a display as claimed in claim 1, wherein if the gate driving device has two gate drivers in the display, a time to charge the pixels for the second time is T/4, where T is the entire frame period.

5. The multiple scanning method for driving a display as claimed in claim 1, wherein if the gate driving device has X gate drivers and each of the gate drivers has N output channels, a scan cycle coefficient M is defined as every M scan lines, the gate driver scan the M scan lines again, a time to charge the pixels for the second time is (M×T)/(2×N×X), where T is the entire frame period.

6. A multiple scanning method for driving a display, the display comprising a display panel, a source driving device and a gate driving device, the gate driving device comprising a plurality of gate drivers, the method comprising:

dividing the display panel into a plurality of pixel blocks for driving, each of the pixel blocks comprising a plurality of pixel rows, and each of the plurality of pixel rows comprising a plurality of pixels and being driven by one of the gate drivers; and alternately scanning the pixel blocks to selectively charge the pixels in each of the pixel blocks for R times with a same target voltage within an entire frame period, thereby to speed up the response time of the pixels to reach a target luminance, wherein R is a refresh coefficient which is defined as the times the pixels are charged or discharged within the frame period, and R is a positive integer greater than or equal to 3, wherein when all of the pixel rows in a prior pixel block are sequentially scanned from the $1^{st}$ pixel row to the last pixel row by a first gate driver of the gate drivers, and each of the pixels of all of the pixel rows in the prior pixel block is coordinately charged with a predetermined target voltage by the source driving device for a first time, and then immediately all of the pixel rows in the prior pixel block are sequentially scanned from the $1^{st}$ pixel row to the last pixel row by the first gate driver again, and each of the pixels of all of the pixel rows in the prior pixel block is coordinately charged with the predetermined target voltage by the source driving device for a second time, and then immediately all of the pixel rows in the prior pixel block are further sequentially scanned from the $1^{st}$ pixel row to the last pixel row by the first gate driver again, and each of the pixels of all of the pixel rows in the prior pixel block is coordinately charged with the predetermined target voltage by the source driving device for an $R^{th}$ time, and then when each of the pixels of all of the pixel rows in the prior pixel block is charged with the predetermined target voltage for R times, all of the pixel rows in a current pixel block are scanned by a second gate driver of the gate drivers and coordinately charged by the source driving device in the same manner as the prior pixel block.

7. The multiple scanning method for driving a display as claimed in claim 6, wherein if the gate driving device has X gate drivers and each of the gate drivers has N output channels, a scan cycle coefficient M is defined as every M scan lines, the gate driver scan the M scan lines again, a sequence number S is defined as N/M, a second time point to charge the pixels for the second time is (2−1)×(M×T)/(R×N×X), and a third time point for driving the pixel is (3−1)×(M×T)/(R×N×X), wherein S, N, X, M and R are integers, and T is the entire frame period.

8. A display, comprising:

a source driving device;

a gate driving device comprising a plurality of gate drivers; and a display panel, for displaying a plurality of frames, when one of the frames is displayed, the display panel is divided into a plurality of pixel blocks for driving, each of the pixel blocks comprising a plurality of pixel rows, and each of the plurality of pixel rows comprising a plurality of pixels and is driven by one of the gate drivers, and alternately scanning the pixel blocks to selectively charge the pixels in each of the pixel blocks twice with a same target voltage within an entire frame period, thereby to speed up the response time of the pixels to reach a target luminance, wherein when all of the pixel rows in a prior pixel block are sequentially scanned from the $1^{st}$ pixel row to the last pixel row by a first gate driver of the gate drivers, and each of the pixels of all of the pixel rows in the prior pixel block is coordinately charged with a predetermined target voltage by the source driving device for a first time, and then immediately all of the pixel rows in the prior pixel block are sequentially scanned from the $1^{st}$ pixel row to the last pixel row by the first gate driver again, and each of the pixels of all of the pixel rows in the prior pixel block is coordinately charged with the predetermined target voltage by the source driving device for a second time, and then when each of the pixels of all of the pixel rows in the prior pixel block is charged with the predetermined target voltage twice, all of the pixel rows in a current pixel block are scanned by a second gate driver of the gate drivers and coordinately charged by the source driving device in the same manner as the prior pixel block.

9. The display as claimed in claim 8, wherein if the gate driving device has X gate drivers in the display, a time to charge the pixels for the second time is $T/(2\times X)$, where T is the entire frame period.

10. The display as claimed in claim 8, wherein if the gate driving device has X gate drivers and each of the gate drivers has N output channels, a scan cycle coefficient M is defined as every M scan lines, the gate driver scan the M scan lines again, a time to charge the pixels for the second time is $(M\times T)/(2\times N\times X)$, where T is the entire frame period.

11. The display as claimed in claim 8, wherein the display is a liquid crystal display (LCD).

12. The display as claimed in claim 8, wherein the display is an organic light emitter diode display (OLED).

13. The display as claimed in claim 8, wherein the display is a plasma display panel (PDP).

14. A display, comprising:

a source driving device;

a gate driving device comprising a plurality of gate drivers; and a display panel, for displaying a plurality of frames, when one of the frames is displayed, the display panel is divided into a plurality of pixel blocks for driving, each of the pixel blocks comprising a plurality of pixel rows, and each of the plurality of pixel rows comprising a plurality of pixels and is driven by one of the gate drivers, and alternately scanning the pixel blocks to selectively charge the pixels in each of the pixel blocks for R times with a same target voltage within an entire frame period, thereby to speed up the response time of the pixels to reach a target luminance, wherein R is a refresh coefficient which is defined as the times the pixels are charged or discharged within the frame period, and R is a positive integer greater than or equal to 3, wherein when all of the pixel rows in a prior pixel block are sequentially scanned from the $1^{st}$ pixel row to the last pixel row by a first gate driver of the gate drivers, and each of the pixels of all of the pixel rows in the prior pixel block is coordinately charged with a predetermined target voltage by the source driving device for a first time, and then immediately all of the pixel rows in the prior pixel block are sequentially scanned from the $1^{st}$ pixel row to the last pixel row by the first gate driver again, and each of the pixels of all of the pixel rows in the prior pixel block is coordinately charged with the predetermined target voltage by the source driving device for a second time, and then immediately all of the pixel rows in the prior pixel block are further sequentially scanned from the $1^{st}$ pixel row to the last pixel row by the first gate driver again, and each of the pixels of all of the pixel rows in the prior pixel block is coordinately charged with the predetermined target voltage by the source driving device for an $R^{th}$ time, and then when each of the pixels of all of the pixel rows in the prior pixel block is charged with the predetermined target voltage for R times, all of the pixel rows in a current pixel block are scanned by a second gate driver of the gate drivers and coordinately charged by the source driving device in the same manner as the prior pixel block.

15. The display as claimed in claim 14, wherein if the gate driving device has X gate drivers and each of the gate drivers has N output channels, a scan cycle coefficient M is defined as every M scan lines, the gate driver scan the M scan lines again, a sequence number S is defined as N/M, a second time point to charge the pixels for the second time is $(2-1)\times(M\times T)/(R\times N\times X)$, and a third time point for driving the pixel is $(3-1)\times(M\times T)/(R\times N\times X)$, wherein S, N, X, M and R are integers, and T is the entire frame period.

16. The display as claimed in claim 15, wherein the display is a liquid crystal display (LCD).

17. The display as claimed in claim 15, wherein the display is an organic light emitter diode display (OLED).

18. The display as claimed in claim 15, wherein the display is a plasma display panel (PDP).

* * * * *